US009561932B2

(12) United States Patent
Salmikuukka et al.

(10) Patent No.: US 9,561,932 B2
(45) Date of Patent: Feb. 7, 2017

(54) METHOD FOR IDENTIFYING AN ELEVATOR ALLOCATED BY AN ELEVATOR SYSTEM, ARRANGEMENT FOR IDENTIFYING AN ELEVATOR ALLOCATED BY AN ELEVATOR SYSTEM AND AN ELEVATOR SYSTEM

(71) Applicant: KONE Corporation, Helsinki (FI)

(72) Inventors: Jukka Salmikuukka, Espoo (FI); Niko Elomaa, Hyvinkää (FI)

(73) Assignee: KONE CORPORATION, Helsinki (FI)

( * ) Notice: Subject to any disclaimer, the term of this patent is extended or adjusted under 35 U.S.C. 154(b) by 541 days.

(21) Appl. No.: 14/079,370

(22) Filed: Nov. 13, 2013

(65) Prior Publication Data

US 2014/0131143 A1 May 15, 2014

(30) Foreign Application Priority Data

Nov. 14, 2012 (FI) ..... 20126195

(51) Int. Cl.
*B66B 1/34* (2006.01)
*B66B 3/00* (2006.01)
*B66B 1/46* (2006.01)

(52) U.S. Cl.
CPC ..... *B66B 3/006* (2013.01); *B66B 1/468* (2013.01); *B66B 2201/4653* (2013.01)

(58) Field of Classification Search
CPC ..... B66B 3/006; B66B 1/468
USPC ..... 187/247, 277, 380, 382, 384, 391, 396
See application file for complete search history.

(56) References Cited

U.S. PATENT DOCUMENTS 5,551,533 A * 9/1996 Ng ..... B66B 3/006 187/390
6,065,570 A * 5/2000 Friedli ..... B66B 1/2458 187/387
6,868,945 B2 * 3/2005 Schuster ..... B66B 1/468 187/380
6,945,365 B2 * 9/2005 Matela ..... B66B 1/20 187/247
6,986,408 B2 * 1/2006 Takeuchi ..... B66B 1/14 187/247

(Continued)

FOREIGN PATENT DOCUMENTS

WO WO 2007/093665 A1 8/2007
WO WO 2011/110748 A1 9/2011

*Primary Examiner* — Anthony Salata
(74) *Attorney, Agent, or Firm* — Birch, Stewart, Kolasch & Birch, LLP

(57) ABSTRACT

A method for identifying an elevator allocated by an elevator system for a user of the elevator system is provided, which elevator system includes a plurality of elevators, and an apparatus that communicates with the elevator system, more particularly with the control system of it, and that is available to a user, which apparatus includes a display. In the method a real-time view of the landscape behind the display is transmitted via the display to the front of the display to the user, and predetermined graphics are presented to the user on the display at a point that transmits to the user a real-time view of the allocated elevator, or in the immediate proximity of said point. An arrangement for identifying an elevator allocated by an elevator system for a user of the elevator system, and also to an elevator arrangement is provided, which implement the aforementioned method.

20 Claims, 2 Drawing Sheets c: camera

(56) References Cited

U.S. PATENT DOCUMENTS

| | | | | |
|---|---|---|---|---|
| 7,377,364 | B2 * | 5/2008 | Tyni | B66B 1/468 187/380 |
| 7,552,802 | B2 * | 6/2009 | Hirade | B66B 1/2458 187/383 |
| 7,712,586 | B2 * | 5/2010 | Legez | B66B 1/20 187/387 |
| 8,047,333 | B2 * | 11/2011 | Finschi | B66B 1/468 187/382 |
| 8,151,942 | B2 * | 4/2012 | Rusanen | B66B 1/468 187/247 |
| 8,651,242 | B2 * | 2/2014 | Sarjanen | B66B 1/468 187/388 |
| 8,857,569 | B2 * | 10/2014 | Friedli | B66B 5/0012 187/384 |
| 2007/0240944 | A1 | 10/2007 | Hirade | |
| 2013/0038522 | A1 | 2/2013 | Nara et al. | |
| 2014/0151160 | A1 * | 6/2014 | Joyce | B66B 1/468 187/388 |

* cited by examiner

12: group control
14: elevator specific control
1, 1': destination call apparatus
2, 2': display
EC: elevator car c: camera

METHOD FOR IDENTIFYING AN ELEVATOR ALLOCATED BY AN ELEVATOR SYSTEM, ARRANGEMENT FOR IDENTIFYING AN ELEVATOR ALLOCATED BY AN ELEVATOR SYSTEM AND AN ELEVATOR SYSTEM

FIELD OF THE INVENTION

The invention relates to elevator systems applicable to the transportation of people and/or of freight. More particularly the invention relates to the identification for the user of an elevator allocated to the user by an elevator system.

BACKGROUND OF THE INVENTION

Passengers using elevators can generally give calls to elevators either in an elevator car and/or in an elevator lobby. Elevator lobbies are typically provided with up/down pushbuttons, by means of which a passenger can order an elevator to the call floor and simultaneously indicate his/her travel direction. After the elevator has arrived at the call-giving floor, the passenger moves into the elevator car and indicates his/her destination floor with the pushbuttons of the car panel in the elevator car. To a constantly increasing extent so-called destination call systems are used in high-rise buildings, in which systems a passenger indicates his/her destination floor already before going into the elevator car. For giving destination calls a passenger uses a destination call-giving apparatus. A destination call-giving apparatus is generally provided with a so-called decimal numeric keypad and with a display. If a passenger is going e.g. to floor 24, he/she keys into the decimal numeric keypad first the number 2 and then the number 4. The destination call apparatus sends the data about the call-giving floor and about the aforementioned floor 24 to the control system of the elevator system. After it has received a destination call, the control system of the elevator system allocates the optimal elevator for the use of the passenger and communicates to the user the elevator allocated to him/her. For example, the control system can send information identifying the allocated elevator to a call-giving apparatus, on which appears e.g. the text "Elevator B". A problem has been that it has been difficult for a user to locate the elevator allocated to him/her. For example, in a large or busy elevator lobby it is not always easy for a user to quickly see and identify an elevator allocated to him/her. It is uncomfortable for a user if he/she must search for his/her elevator. This can also result in unnecessary extra traffic in the elevator lobby. The aforementioned types of problems have occurred more particularly when the call-giving apparatus is a portable call-giving apparatus, e.g. a mobile phone. Since the system does not know the location of the user, it has not been possible to indicate to him/her simply where the elevator allocated to him/her is located.

BRIEF DESCRIPTION OF THE INVENTION

The aim of the invention is to solve the aforementioned problems of prior-art solutions as well as the problems disclosed in the description of the invention below. More particularly, the aim is to improve the identification of an allocated elevator for a user. Some embodiments, inter alia, are disclosed in which the allocated elevator can be identified for the user graphically and personally. Some embodiments, inter alia, are disclosed in which the allocated elevator can be effectively identified via a portable apparatus.

Some embodiments, inter alia, are disclosed which enable rapid localization of an allocated elevator, in which case the walking time to the elevator shortens. In this way also walking times can be estimated better, which reduces the number of wasted calls and this can indirectly improve the efficiency of the whole elevator system. Some embodiments, inter alia, are disclosed which are easy to maintain and modify.

A method according to the invention is disclosed for identifying an elevator allocated by an elevator system for a user of the elevator system, which elevator system comprises a plurality of elevators, and an apparatus that communicates with the elevator system, more particularly with the control system of it, and that is available to a user, which apparatus comprises a display. In the method a real-time view of the landscape (of the elevator system) is transmitted to a user via the display, and predetermined graphics are presented to the user on the display at a point that transmits to the user a real-time view of the allocated elevator, or in the immediate proximity of said point. Graphics, together with a real-world background, form a graphical way of giving to a user information about the elevator allocated to him/her.

In one preferred embodiment a real-time view of the landscape behind the display is transmitted via the display to the front of the display to the user.

In one preferred embodiment a point on the display is determined, which transmits to the user a real-time view of the allocated elevator.

In one preferred embodiment the aforementioned predetermined graphics cover a part of the aforementioned real-time view. In this way it is easy for a user to discern the graphics on the display and distinguish them from the real-time view. The graphics preferably cover only a small part of the view, e.g. less than 20% of the area of the view. In this way the details of the view are still very recognizable.

In one preferred embodiment the predetermined graphics is an arrow icon, which points on the display to the point that transmits to the user a real-time view of the allocated elevator.

In one preferred embodiment the predetermined graphics is an icon, which surrounds on the display a point that transmits to the user a real-time view of the allocated elevator.

In one preferred embodiment the aforementioned predetermined graphics are graphics, e.g. coloring or light, which are presented on the display at a point that transmits to the user a real-time view of the allocated elevator.

In one preferred embodiment the display simultaneously transmits a real-time view of a number of elevators, and the aforementioned graphics are presented on the display only at a point that transmits to the user a real-time view of the allocated elevator, or only in the immediate proximity of the point in question, thus identifying one elevator from the plurality of elevators.

In one preferred embodiment the determination of the aforementioned point is repeated, and predetermined graphics are presented to the user on the display at the newly determined point that transmits to the user a real-time view of the allocated elevator, or in the immediate proximity of the newly determined point in question. Thus, if the aforementioned point has displaced, e.g. owing to displacement of the viewing angle of the device or as a consequence of the user moving, the presentation point of the graphics is displaced correspondingly.

In one preferred embodiment the view is presented on the display as a video image. In this way the attitude and location of the display in relation to the view can be freely selected.

In one preferred embodiment for transmitting a real-time view, the landscape is videophotographed continuously and the video image is presented on the display. In this way the real-time view can be simply transmitted.

In one preferred embodiment the aforementioned allocated elevator or elevator group, which comprises the aforementioned allocated elevator, is identified in the video image. If the aforementioned allocated elevator or elevator group, which comprises the aforementioned allocated elevator, is identified in the video image, the aforementioned predetermined graphics are presented on the display in the aforementioned manner.

In one preferred embodiment the landscape is photographed with a camera, which is integrated into the aforementioned display or into the apparatus comprising the aforementioned display. The camera is preferably connected to the display in a fixed manner.

In one preferred embodiment the video image is analyzed for identifying the aforementioned allocated elevator or elevator group, which comprises the aforementioned allocated elevator.

In one preferred embodiment the aforementioned allocated elevator or elevator group, which comprises the aforementioned allocated elevator, is identified in the video image by identifying from the video image some identifier of the aforementioned allocated elevator or elevator group, such as a feature, mark or signal of the elevator or elevator group in question.

In one preferred embodiment for identifying the aforementioned allocated elevator or elevator group that comprises the aforementioned allocated elevator, an identifier of the aforementioned allocated elevator or elevator group, such as a feature, mark or signal of the elevator or elevator group in question, is identified from the video image, and the identifier is compared to an identifier database, in which the identifier is associated with a certain elevator or a certain elevator group, and if the elevator or elevator group associated with the identifier corresponds to the allocated elevator or elevator group that comprises the aforementioned allocated elevator, the aforementioned predetermined graphics are presented on the display in the aforementioned manner.

In one preferred embodiment the apparatus is portable. With the method it is particularly advantageous to produce the identification of the allocation data in connection with a portable apparatus in the manner presented above. Since the exact location of the user is not known, and a user can be far from his/her elevator, identification is awkward with conventional methods.

In one preferred embodiment the display is at least partly transparent, in which case the real-time view of the landscape behind the display is visible to the user on the front of the display through the display. In this way the display can transmit the view behind it simply in real-time to a user on the front side of it.

In one preferred embodiment the display is supported on a fixed mounting base, preferably on the floor, to be stationary in its position.

In one preferred embodiment the display is disposed at a distance from the elevators of the elevator system, and the rear side of the display is directed towards the elevators of the elevator system. In this way the display can transmit the view behind it to a user on the front side of it, and it is simple for the user to associate the view he/she sees via the display with the actual view.

In one preferred embodiment a point on the display, which point transmits to the user a real-time view of the allocated elevator, is determined on the basis of the location of the user (more particularly on the basis of the location of the user in relation to display). In this way differences in the viewing angle can be taken into account. Preferably the location of the user, more particularly the location of the eye of the user, in relation to the display is determined and, on the basis of the location of the eye, a point on the display, which point is on a straight line between the eye of the user and the allocated elevator or in the proximity of it, is determined, and the predetermined graphics are presented at the point in question or in the immediate proximity of that point in one of the ways defined above.

In one preferred embodiment with the apparatus the destination floor selection of the user is received and a destination call signal is sent to the control system of the elevator system, which signal identifies the destination floor selected by the user.

In one preferred embodiment a response signal to the destination call signal sent to it is received from the control system of the elevator system, which response signal contains information identifying the allocated elevator, and the allocated elevator is identified in the aforementioned manner for the user.

In one preferred embodiment the aforementioned display is a touch-sensitive display. One advantage, among others, is that via a touch-sensitive display a user can simply enter a destination floor selection into the apparatus.

Also disclosed is an arrangement according to the invention for identifying an elevator allocated by an elevator system for a user of the elevator system, which elevator system comprises a plurality of elevators, and an apparatus that communicates with the elevator system, more particularly with the control system of it, and that is available to a user, which apparatus comprises a display. The apparatus is arranged to transmit a real-time view of the landscape via the display, and to present predetermined graphics to the user on the display at a point that transmits to the user a real-time view of the allocated elevator, or in the immediate proximity of said point.

The apparatus is preferably according to what is described in any whatsoever preceding paragraph/arranged to function according to what is described in any whatsoever preceding paragraph. The apparatus preferably comprises a processing unit for performing the procedures of the method.

An elevator system according to the invention is also disclosed, which system comprises a plurality of elevators, and a control system for controlling the aforementioned elevators, which control system is arranged to allocate an elevator of the elevator system in response to a received destination call. The elevator system comprises any of the arrangements described above for identifying an elevator allocated by an elevator system for a user of the elevator system.

Preferably the aforementioned real-time view is realistic in its manner of presentation. In this case the view is essentially similar to what is seen without the apparatus. In this way identification of the allocated elevator is easiest for the user. For example, when the view is transmitted as an image implemented on the display, the image is preferably a realistic image. Preferably the image is as similar as possible. Each elevator of the elevator system is most preferably an elevator applicable to the transporting of people and/or of freight, which elevator is installed in a building, to travel in a vertical, or at least essentially vertical, direction, preferably on the basis of calls made at least from a floor landing and possibly also from a car. The elevator car preferably has an interior space, which is suited to receive a passenger or a number of passengers. The elevator preferably comprises at least two, possibly more, floor landings to be served. Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the framework of the basic inventive concept in conjunction with other embodiments.

BRIEF DESCRIPTION OF THE FIGURES

The invention will now be described in more detail in connection with its preferred embodiments, with reference to the attached drawings, wherein.

DETAILED DESCRIPTION OF THE INVENTION

Figure 1:
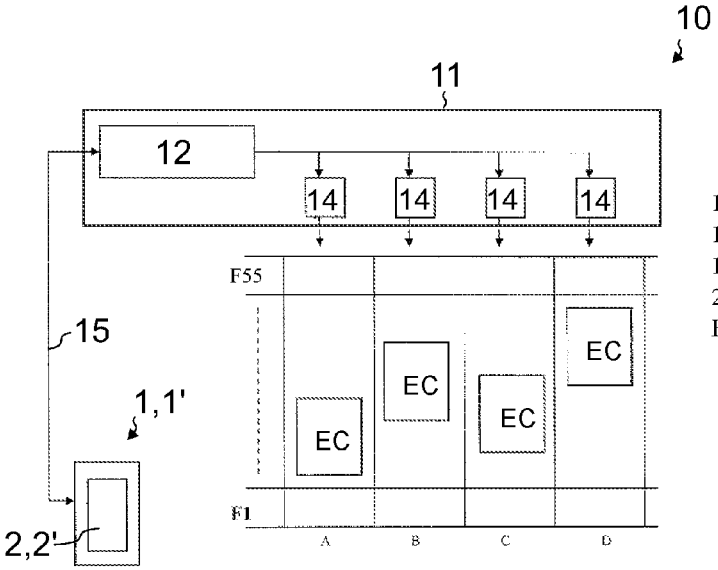
FIG. 1 presents an elevator system, which comprises an arrangement according to the invention, which arrangement implements the method according to the invention.

FIG. 1 presents an elevator system 10, which comprises a plurality of elevators A, B, C and D and also a control system 11. The control system 11 is arranged to allocate an elevator of the elevator system 10 in response to a received call, such as in response to a destination call, and to control the elevators A-D, more particularly the elevator cars C of them, on the basis of allocations. The elevator system 10 comprises an arrangement for identifying an elevator A, B, C or D allocated by an elevator system 10 for a user of the elevator system 10, which arrangement comprises an apparatus 1,1' that communicates with the elevator system 10, more particularly with the control system 11 of it, and that is available to a user 20, which apparatus 1,1' comprises a display 2,2'. The apparatus 1,1' is arranged to transmit a real-time view of the landscape of the elevator system 10 via the display 2,2' to the user 20, and to present predetermined graphics 3,3' to the user 20 on the display 2,2' at a point that transmits to the user 20 a real-time view of the allocated elevator A, B, C or D, or in the immediate proximity of said point. In this way the graphics indicate to the user e.g. the elevator that is the elevator allocated to the user from the one or more elevators A, B, C, D that are behind the display 2,2'. Graphics, together with a real-world background, form a graphical way of giving to a user information about the elevator allocated to him/her. A real-time view enables, inter alia, traffic visible in the image area of the view to not be detrimental to identification. The traffic visible in the image area is even useful, because the user can use people visible in the image area as landmarks for identifying the elevator allocated to him/her. The structures or markings of elevators can be awkward for some users to see or to distinguish from each other. A real-time view facilitates identification particularly in these types of cases.

The apparatus 1,1' preferably functions as a destination call-giving apparatus, in which case it is arranged to receive the destination floor selection of a user, and to send a destination call signal to the control system 11 of the elevator system 10, which signal identifies the destination floor selected by the user. The apparatus 1,1' is further preferably arranged to receive a response signal to the destination call signal sent to it from the control system 11 of the elevator system 10, which response signal contains information identifying the allocated elevator, and the allocated elevator is identified in the aforementioned manner for the user.

For controlling the elevators the control system 10 can be such that it preferably comprises a group control 12 of the elevator system and also elevator-specific controls 14. The elevators serve in the case of FIG. 1 the floors 1-55 (F1-F55) in the building. A destination call apparatus 1,1' is connected via a data transfer channel 15 to the control system 11. The apparatus 1,1' can be portable, e.g. in the form of a mobile phone or tablet, or a supported device fixed to be stationary, e.g. in an elevator lobby. The data transfer channel 15 can be any wireless or wireline data transfer channel whatsoever that is suited to the purpose. When the apparatus 1,1' is portable, the data transfer channel 15 is preferably wireless.

The elevator system 10 functions in such a way that a destination floor is selected with an apparatus capable of giving a call, which apparatus here is the aforementioned apparatus 1,1'. The apparatus 1,1' sends a destination call to the control system 11, which destination call contains information about the destination floor selected by the user of the destination call-giving apparatus 1,1'. The control system 11 is arranged to allocate according to a certain predetermined logic some elevator of the elevator system 10 in response to a destination call received from the aforementioned destination call-giving device 1,1', and to communicate to the apparatus 1,1' which elevator has been allocated to it. After the allocation the control system 11 controls the allocated elevator car EC of the elevator to the floor on which the aforementioned destination call was given for taking the user (i.e. passenger) on board, and transports the user to the destination floor. The aforementioned logic selects the most advantageous elevator preferably on the basis of predetermined criteria, which elevator can transport the user of the destination call-giving device (i.e. passenger) to the destination floor.

Figure 2:
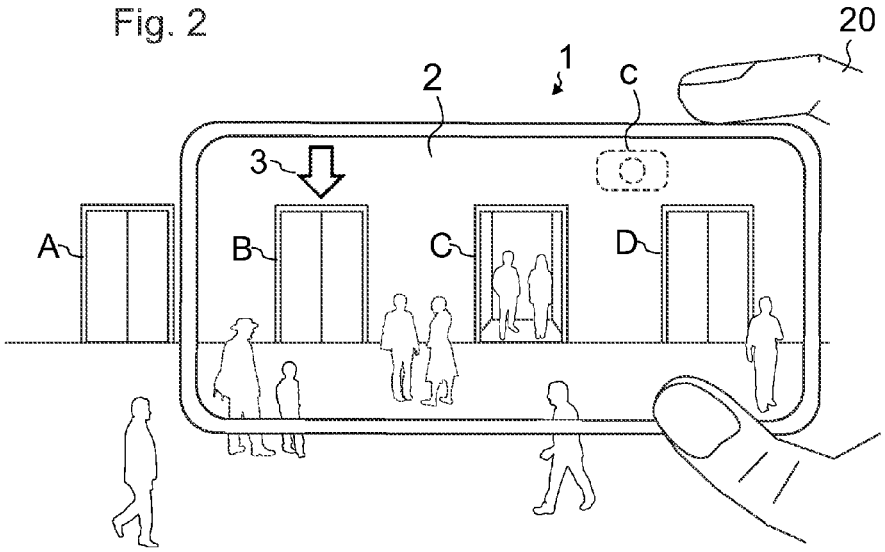
FIG. 2 presents an implementation according to a first embodiment of the invention.

FIG. 2 presents an arrangement according to the first embodiment for identifying an elevator A, B, C or D allocated by an elevator system 10 for a user of the elevator system 10, which arrangement implements a method according to the first embodiment of the invention. In the embodiment presented the apparatus 1 is portable and comprises a camera c. The apparatus 1 can be e.g. a mobile phone or tablet. A real-time view of the landscape of the elevator system behind the display 2 is transmitted via the display 2 to the front of the display 2 to the user 20. For this purpose, the landscape behind the display is videophotographed continuously with a camera c and the video image is presented on the display 2. The view is therefore presented as a video image. The image is preferably a realistic image, i.e. essentially similar to what is seen with the human eye without the apparatus. The apparatus 1 is arranged to identify from the video image either an individual allocated elevator or alternatively an elevator group, which comprises the aforementioned allocated elevator. If the aforementioned allocated elevator or elevator group, which comprises the aforementioned allocated elevator, is identified in the video image, the aforementioned predetermined graphics 3 are presented in the aforementioned manner on the display 2 at a point that transmits to the user 20 a real-time view of the allocated elevator A, B, C or D, or in the immediate proximity of the point in question. The aforementioned allocated elevator or elevator group, which comprises the aforementioned allocated elevator, is identified from the image preferably by identifying from the image the identifier of some aforementioned elevator or elevator group. The identifier can be a feature, mark or signal of the elevator or elevator group in question. Preferably the identifier identified from an image is compared to an identifier database (which identifier database is preferably recorded in a memory M), in which the identifier is associated with a certain elevator or elevator group, and if the elevator or elevator group associated with the identifier corresponds to the allocated elevator or elevator group that comprises the aforementioned allocated elevator, the aforementioned predetermined graphics 3 are presented on the display 2 in the aforementioned manner. For identifying the allocated elevator or elevator group, which comprises the aforementioned allocated elevator from the video image, the video image is analyzed by action of the processing unit, which processing unit is preferably a part of the aforementioned apparatus 1 (e.g. the processing unit PU, which is presented in FIG. 4). For this image recognition softwares that are, per se, known in the art can be used.

The aforementioned predetermined graphics 3 cover a part of the aforementioned real-time view, in which case it is easy for a user to discern it on the display and distinguish it from the real-time view. The graphics are produced therefore in this case to cover a part of the real-time video image. The camera c is described with a dashed line in FIG. 2, because it is installed on the rear side of the display, to film the landscape at the rear of the display. The camera is preferably connected to the display 2 in a fixed manner, in which case its image area moves according to the movement of the camera c, e.g. the image area displaces towards the side when the apparatus 1, and therefore also the camera c, is turned to the side.

In addition, it is possible from the video image (e.g. by an action of the processing unit PU of the apparatus 1), e.g. in connection with the aforementioned identification, to determine a point on the display 2, which point transmits to the user 20 a real-time view of the allocated elevator, in which case a favorable presentation point for the graphics can be simply ascertained. When an individual allocated elevator is arranged to be identified from an image, the aforementioned point on the display 2, which point transmits to the user 20 a real-time video image of the allocated elevator, corresponds to the point of the allocated elevator on the display. In an alternative, wherein an elevator group, which comprises the aforementioned allocated elevator, is arranged to be identified from an image, on the display 2 the point that transmits to the user 20 a real-time view of the allocated elevator can be deduced based on the information about the positioning of the elevators of the elevator group with respect to each other. For example, when the allocated elevator is elevator A, which is known to be the elevator on the left-hand side, the aforementioned point can be determined on the left-hand edge on the display. In this way a favorable presentation point of the graphics can be simply ascertained. The display 2 is preferably a touch-sensitive display, and preferably it is also possible for a user 20 to select a destination floor using it.

Figure 3:
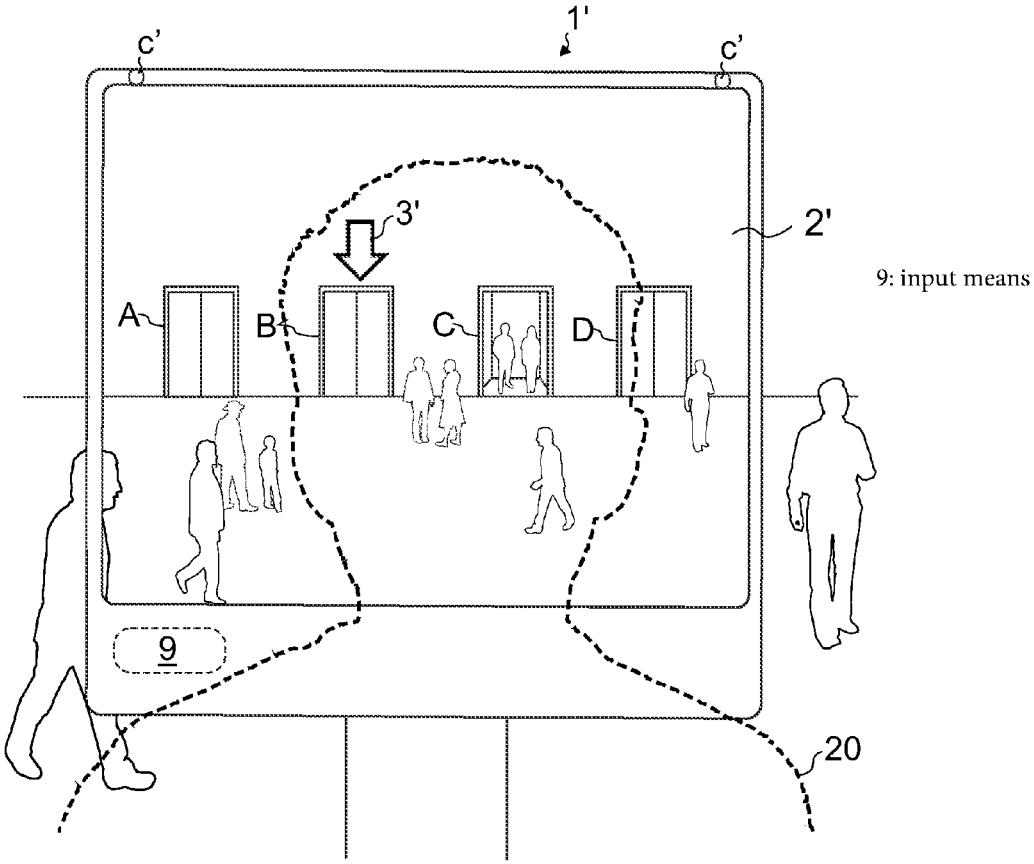
FIG. 3 presents an implementation according to a second embodiment of the invention.

FIG. 3 presents an arrangement according to a second embodiment for identifying an elevator A, B, C or D allocated by an elevator system 10 for a user of the elevator system 10, which arrangement implements a method according to the second embodiment of the invention. The display 2' is at least partly transparent, in which case the real-time view of the landscape behind the display 2' is visible to the user 20 on the front of the display 2' through the display 2'. The view is realistic owing to the transparency, i.e. essentially similar to what is seen with the human eye without the apparatus. The display can be a so-called semi-transparent display. The display 2' is supported on a fixed mounting base, preferably on the floor of an elevator lobby, to be stationary in its position. The display 2' is disposed at a distance from the elevators A-D of the elevator system, and the rear side of the display 2' faces towards the elevators A-D of the elevator system. Predetermined graphics are displayed to the user 20 on the display 2 at a point that transmits to the user 20 a real-time view of the allocated elevator A, B, C or D, or in the immediate proximity of the point in question. The aforementioned predetermined graphics 3' cover a part of the aforementioned real-time view, in which case it is easy for a user 20 to discern it on the display and distinguish it from the real-time view. The arrangement can be implemented in such a way that also on the display 2' a point is determined that transmits to the user 20 a real-time view of the allocated elevator. This is not, however, necessary, because for each elevator there can be a predetermined point, at which the graphics 3' are presented when the elevator in question is the allocated elevator. Preferably, the aforementioned point on the display 2', which transmits to the user 20 a real-time view of the allocated elevator, is determined on the basis of the location of the user 20. In this way differences in the viewing angle can be taken into account. More particularly, it is advantageous that in this case the location of the user 20, more particularly the location of the eye of the user 20, in relation to the display is determined and, on the basis of the location of the eye, on the display 2' a point that is on a straight line between the eye of the user 20 and the allocated elevator A, B, C or D or in the proximity of the point in question is determined, and after it the predetermined graphics 3' are presented at the point in question or in the immediate proximity of the point in question in one of the ways defined above. In this way variations in length of the user do not result in producing the graphics in the wrong point. For determining the position of the user, more particularly the position of the eye of the user, the apparatus 1' can comprise means c' for this purpose. These means can comprise e.g. a camera c', on the basis of the image of which the position of the user, preferably the position of the eye of the user, is arranged to be identified (e.g., by action of the processing unit of the apparatus 1').

In the embodiments presented the apparatus 1,1' functions as a destination call-giving apparatus in addition to the function of identifying the allocated elevator. In this case, in addition to the functions relating to identification of the elevator, the apparatus 1,1' receives the destination floor selection of the user, and sends a destination call signal to the control system 11 of the elevator system 10, which signal identifies the destination floor selected by the user. Likewise the apparatus 1,1' receives a response signal to the destination call signal sent to it from the control system 11 of the elevator system 10, which response signal contains information identifying the allocated elevator, and the allocated elevator is identified with the apparatus 1,1' in the aforementioned manner for the user.

In the embodiments presented the aforementioned predetermined graphics 3,3' are an arrow icon, which points on the display to the point that transmits to the user 20 a real-time view of the allocated elevator. In this way identification can be performed in a universal manner. It is also simple for the user to distinguish an arrow icon from the real-time view. Alternatively, the aforementioned predetermined graphics can be of some other type. A preferred alternative is that the predetermined graphics is an icon, such as a circle or curve, which surrounds on the display a point that transmits to the user 20 a real-time view of the allocated elevator. Another alternative is that the aforementioned predetermined graphics could be graphics, e.g. coloring or light, which is presented on the display at a point that transmits to the user a real-time view of the allocated elevator. For example, the coloring or light can be such that the real-time view is partly visible through it. Another alternative is that the aforementioned predetermined graphics could be in text format. The aforementioned predetermined graphics (in any of the aforementioned alternatives) can flash on the display, in which case their distinguishability from the real-time view is good.

It is advantageous that the display 2,2' simultaneously transmits a real-time view of a number of elevators A, B, C, D, and the aforementioned graphics 3,3' are presented only at a point that transmits to the user 20 a real-time view of the allocated elevator, or only in the immediate proximity of the point in question, thus identifying only one elevator from the plurality of elevators.

As presented above, it is advantageous that a determination phase is performed, in which a point on the display 2,2' is determined, which point transmits to the user 20 a real-time view of the allocated elevator. In this way a favorable presentation point of the graphics can be ascertained. Preferably this type of determination phase is repeated after presentation of the graphics, and afterwards the aforementioned predetermined graphics 3,3' are presented to the user 20 on the display 2,2' at the newly determined point that transmits to the user 20 a real-time view of the allocated elevator, or in the immediate proximity of said newly determined point. In this way displacement of the point in question on the display does not result in presentation of the graphics in the wrong place. The presentation point of the graphics is displaced correspondingly to what the point of the allocated elevator being transmitted has displaced.

Figure 4:
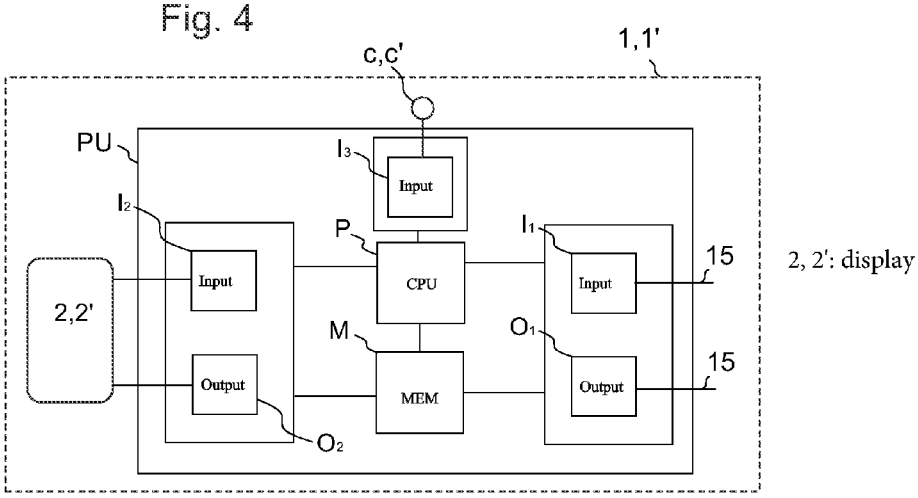
FIG. 4 presents a diagrammatic plan, according to which it is advantageous to implement the apparatus.

FIG. 4 presents a diagrammatic plan, according to which it is advantageous to implement the apparatus 1,1'. The apparatus 1,1' comprises a processing unit PU and a display 2,2' that are in telecommunications connection with each other. The processing unit PU 2 preferably comprises at least one processor P, which can be brought into telecommunications contact with a memory M, which is preferably also comprised in the processing unit PU 2. In addition, the processing unit PU comprises connected to the processor P an input $I_1$ from the control system of the elevator system, and an input $I_2$ from the touch-sensitive display, and an output $O_1$ to the control system of the elevator system, and an output $O_2$ to the touch-sensitive display. In addition, the processing unit PU can comprise connected to a processor P an input $I_3$ from the camera c,c'. Each of the aforementioned inputs and outputs is preferably able to transmit an electrical signal. Some of these signals can be wireless. For example, the aforementioned output $O_1$ to the control system of the elevator system can comprise a transmitter, such as e.g. an antenna, for transmitting a wireless signal to the control system 11 of the elevator system 10. This is advantageous e.g. when the destination call-giving device is portable. Correspondingly the input $I_1$ from the control system of the elevator system can comprise a receiver, such as e.g. an antenna, for receiving a wireless signal. The input $I_1$ and the output $O_1$ can use a shared antenna. The processing unit PU, more particularly the processor P of it, can perform the aforementioned procedures of the apparatus 1,1'. For example, the processing unit produces the aforementioned graphics on the display 2,2'. Likewise the processing unit processes the signals sent and/or received by the apparatus 1,1', including a signal identifying an allocated elevator to be received from the elevator system. As stated above, the apparatus 1,1' can comprise a memory M. Alternatively the memory M is separate to the processing unit PU 2, such as in connection with the control system of the elevator or so-called cloud memory. The memory M stores at least program commands for performing the phases of the method, according to which program commands the processing unit PU can perform the phases of the method. The memory preferably also stores the identifier data needed for identifying an elevator, possibly data relating to the graphics 3,3'. As stated above, it is advantageous that the apparatus 1,1' also functions as a destination call-giving apparatus. For this purpose, the apparatus 1,1' also comprises means 2,9, PU available to a user for selecting a destination floor. The aforementioned means can comprise a keypad separate from the display or corresponding 9, for receiving an input of the user, or the display 2,2' can be a touch-sensitive display and receive inputs of the user. The processing unit PU processes the inputs of the user, and sends a destination call according to an input of the user to the control system 11 of the elevator.

As presented above, in the embodiment of FIG. 2 the apparatus 1 is portable. The display 2 could alternatively, however, be supported in a manner corresponding to the solution of FIG. 3 on a fixed mounting base, preferably on the floor of an elevator lobby, to be stationary in its position. The display 2 would in this case be disposed at a distance from the elevators A-D of the elevator system, and the camera c of the display 2 would point towards the elevators A-D of the elevator system. In this way the type of implementation of the apparatus 1' of FIG. 3 could be produced, owing to the video image, without the display being transparent and in such a way that determination of the location of the user 20 would not need to be performed.

Presented above is the identification of an allocated elevator for a user of an elevator system. If the user is not in the proximity of the elevator system, an indication of to where the user must travel to get to the elevator system can be given in a corresponding manner. In the embodiments presented the identification is made by means of graphics. In the case of a portable apparatus, alternatively or additionally, a sound or vibration of the apparatus can be brought about when the allocated elevator is visible in the view.

It is obvious to the person skilled in the art that in developing the technology the basic concept of the invention can be implemented in many different ways. The invention and the embodiments of it are not therefore limited to the examples described above, but instead they may be varied within the scope of the claims.

The invention claimed is:

1. A method for identifying an elevator allocated by an elevator system for a user of the elevator system, which elevator system comprises a plurality of elevators, and an apparatus that communicates with a control system of the elevator system, and that is available to a user, which apparatus comprises a display, the method comprising transmitting a real-time view of the landscape via the display to the user, and presenting predetermined graphics to the user on the display at a point that transmits to the user a real-time view of the allocated elevator, or in the immediate proximity of said point.

2. The method according to claim 1, wherein a real-time view of the landscape behind the display is transmitted via the display to the front of the display to the user.

3. The method according to claim 1, wherein on the display a point is determined that transmits to the user a real-time view of the allocated elevator.

4. The method according to claim 1, wherein the aforementioned predetermined graphics cover a part of the aforementioned real-time view.

5. The method according to claim 1, wherein the predetermined graphics are an arrow icon, which points on the display to the point that transmits to the user a real-time view of the allocated elevator, or an icon, which surrounds on the display a point that transmits to the user a real-time view of the allocated elevator, or graphics, which are presented on the display at a point that transmits to the user a real-time view of the allocated elevator.

6. The method according to claim 1, wherein the determination of the aforementioned point is repeated, and predetermined graphics are presented to the user on the display at the newly determined point that transmits to the user a real-time view of the allocated elevator, or in the immediate proximity of the newly determined point in question.

7. The method according to claim 1, wherein for transmitting a real-time view, the landscape is videophotographed continuously and the video image is presented on the display.

8. The method according to claim 1, wherein the aforementioned allocated elevator or elevator group, which comprises the aforementioned allocated elevator, is identified in the video image.

9. The method according to claim 1, wherein the landscape is photographed with a camera, which is integrated into the apparatus comprising the aforementioned display.

10. The method according to claim 1, wherein the apparatus is portable.

11. The method according to claim 1, wherein the display is at least partly transparent, in which case the real-time view of the landscape behind the display is visible to the user on the front of the display through the display.

12. The method according to claim 1, wherein with the apparatus the destination floor selection of the user is received and a destination call signal is sent to the control system of the elevator system, which signal identifies the destination floor selected by the user.

13. The method according to claim 1, wherein that with the apparatus a response signal to the destination call signal sent to it is received from the control system of the elevator system, which response signal contains information identifying the allocated elevator, and the elevator allocated to the user is identified for the user in the aforementioned manner.

14. An arrangement for identifying an elevator allocated by an elevator system for a user of the elevator system, which elevator system comprises a plurality of elevators, and an apparatus that communicates with a control system of the elevator system, and that is available to a user, which apparatus comprises a display, wherein the apparatus is arranged to transmit to the user via the display a real-time view of the landscape, and to present to the user predetermined graphics on the display at the point that transmits to the user a real-time view of the allocated elevator, or in the immediate proximity of said point.

15. An elevator system, which comprises a plurality of elevators, and a control system for controlling the aforementioned elevators, which control system is arranged to allocate an elevator of the elevator system in response to a received destination call, wherein the elevator system comprises an arrangement, according to claim 14, for identifying an elevator allocated by an elevator system for a user of the elevator system.

16. The method according to claim 2, wherein on the display a point is determined that transmits to the user a real-time view of the allocated elevator.

17. The method according to claim 2, wherein the aforementioned predetermined graphics cover a part of the aforementioned real-time view.

18. The method according to claim 3, wherein the aforementioned predetermined graphics cover a part of the aforementioned real-time view.

19. The method according to claim 2, wherein the predetermined graphics are an arrow icon, which points on the display to the point that transmits to the user a real-time view of the allocated elevator, or an icon, which surrounds on the display a point that transmits to the user a real-time view of the allocated elevator, or graphics, which are presented on the display at a point that transmits to the user a real-time view of the allocated elevator.

20. The method according to claim 3, wherein the predetermined graphics are an arrow icon, which points on the display to the point that transmits to the user a real-time view of the allocated elevator, or an icon, which surrounds on the display a point that transmits to the user a real-time view of the allocated elevator, or graphics, which are presented on the display at a point that transmits to the user a real-time view of the allocated elevator.

* * * * *